US005618227A

United States Patent [19]

Tsutsumi et al.

[11] Patent Number: 5,618,227

[45] Date of Patent: Apr. 8, 1997

[54] APPARATUS FOR POLISHING WAFER

[75] Inventors: Yukio Tsutsumi; Shigeo Kumabe; Keisuke Takahashi, all of Tokyo, Japan

[73] Assignees: Mitsubushi Materials Corporation; Mitsubushi Materials Silicon Corporations, both of Tokyo, Japan

[21] Appl. No.: 522,527

[22] Filed: Sep. 5, 1995

Related U.S. Application Data

[63] Continuation of Ser. No. 104,336, Aug. 9, 1993, abandoned.

[30] Foreign Application Priority Data

Sep. 18, 1992 [JP] Japan ..... 4-250125

[51] Int. Cl.[6] ..... B24B 7/04; B24B 7/22

[52] U.S. Cl. ..... 451/288; 451/66; 451/289; 451/290; 451/334; 451/67

[58] Field of Search ..... 451/66, 67, 285, 451/287, 288, 289, 290, 334

[56] References Cited

U.S. PATENT DOCUMENTS

| | | | |
|---|---|---|---|
| 3,292,312 | 12/1966 | Snyder | 51/131.4 X |
| 3,504,457 | 4/1970 | Jacobsen et al. | 51/131.4 |
| 3,857,123 | 12/1974 | Walsh . | |
| 4,141,180 | 2/1979 | Gill, Jr. et al. . | |
| 4,270,314 | 6/1981 | Cesna | 51/131.4 |
| 4,313,284 | 2/1982 | Walsh | 51/131.4 |
| 4,502,252 | 3/1985 | Iwabuchi | 51/131.4 X |
| 4,680,893 | 7/1987 | Cronkhite et al. | 451/67 X |
| 4,918,869 | 4/1990 | Kitta | 51/131.4 X |
| 5,036,630 | 8/1991 | Kaanta et al. | 51/131.4 X |
| 5,193,316 | 3/1993 | Olmstead | 51/131.4 X |
| 5,329,732 | 7/1994 | Karlsrud et al. | 451/334 X |
| 5,498,199 | 3/1996 | Karlsrud et al. | 451/66 X |

FOREIGN PATENT DOCUMENTS

| | | | |
|---|---|---|---|
| 451471 | 10/1991 | European Pat. Off. . | |
| 246502 | 6/1987 | Germany | 51/131.5 |
| 5-152262 | 6/1993 | Japan . | |
| 2072550 | 10/1981 | United Kingdom . | |

*Primary Examiner*—Joseph M. Gorski
*Attorney, Agent, or Firm*—Scully, Scott, Murphy and Presser

[57] ABSTRACT

There is disclosed a wafer-polishing apparatus suitably designed to carry out a chemical mechanical polishing operation. The apparatus includes a lower polishing plate assembly, a first rotating mechanism for rotating the first polishing plate assembly, an upper polishing plate assembly, a second rotating mechanism for rotating the upper polishing plate assembly, a pressing mechanism, a conveying mechanism and a discharging mechanism. The lower polishing plate assembly includes a lower polishing plate, a polishing pad, a porous sheet interposed between the lower polishing plate and the polishing pad. The porous sheet has a thickness of 0.5 to 3 mm, and is formed of a foaming resin. The upper polishing plate assembly includes an upper polishing plate, a plate-like chuck and a backing pad, a pressure reducing unit, and a cleaning unit.

4 Claims, 13 Drawing Sheets

APPARATUS FOR POLISHING WAFER

This is a continuation of application Ser. No. 08/104,336 filed on Aug. 9, 1993, and now abandoned.

BACKGROUND OF THE INVENTION

The present invention pertains to an apparatus for polishing wafers, and in particular to the polishing apparatus which is suitably used to manufacture a large-diameter wafer in which the required flatness of the surface of the wafer must be less than 0.5 micron rule in order to be useful in the manufacture of ULSIs (Ultra Large Scale integrated Circuits).

The requirements of typical half-micron rule ULSIs, for example, for 16M DRAM (Dynamic Random Access Memory), are large wafer diameter and extreme flatness. Wafers must be at least 200 mm in diameter, and the flatness thereof must meet the requirements of photolithography.

However, it has been found that in conventional wafer manufacturing methods, it is difficult to obtain sufficient flatness of the wafer. Namely, in the manufacture of wafers 200 mm or more in diameter, the requirements of the flatnesses of the wafers are very strict compared with those for the manufacture of wafers of smaller diameters. In particular, when a photolithographic process is utilized, the smaller the line width rule, the shallower the depth of focus becomes. Therefore, as the line width of an exposure is reduced, the flatness requirements increase. For instance, 16M devices have been produced using a tilting mechanism requiring a local flatness of less than 0.5 μm in a 25 mm×25 mm area of the front wafer surface. Of course, higher global flatness and total flatness (back surface reference flatness) are also required.

To meet these requirements, it is particularly important to improve the polishing process during wafer manufacture. For example, Japanese Patent Application, Laid-Open No. 5-152262, discloses a wax-mount process in which large carrier plates of higher flatness are utilized to adhere wafers to be polished. The process is conducted in a higher grade cleanroom, and special care is taken to clean carrier plates and wafers to reduce the number of particles sandwiched between the carrier plate and the wafer in the wax. Additionally, wax thickness is reduced to improve flatness.

It is well-known that the particles sandwiched between the carrier plate and the wafer in the wax are the cause of "dimples" on the front surface of the wafer after demounting from the carrier plates. A dimple is a shallow depression with gently sloping sides that exhibits a concave, spheroidal shape, and these dimples are often overlooked during unaided visual inspection, and the presence of these dimples reduces the degree of flatness of chips for 16M. However, such defects may be easily detected using Makyo (parallel beam reflection image).

Unfortunately, the aforesaid process cannot eliminate dimple defects. By reducing the wax thickness to improve flatness, protrusions and ripples on the back surface cause dimple and wave defects on the front surface. Protrusions on the back surface are the locations at which adhered particles are protected from being etched-off during etching processing, and ripples result because etching processings cannot be performed uniformly over the entire surface although many attempts have been made, for example, by rotating wafers in the etching solution.

Further attempts at improvement of the etching process have been unsuccessful, but the inventors have resolved the aforesaid problems by developing a half-polishing method which involves removing protrusions and half-cutting peaks of ripples by polishing to improve flatness of back surface.

Furthermore, when a wafer is provided with a polysilicon film for extrinsic gettering, it is inevitable that so-called "mound" defects are created by particles or flakes falling on the wafers during the polysilicon CVD (Chemical Vapor Deposition) process, and also that irregularities of film thickness result due to irregularity of gas flow and ripples on the wafer surface. When wax-mounting a wafer with CVD polysilicon film and then polishing, irregularities on the back surface cause defects on the front surface, such as dimples and waves, and thereby deteriorate flatness. Therefore, by the half-polishing technique which involves eliminating mounds and cutting peaks of the ripples in a degree not exceeding the film thickness so as not to expose the inner wafer, a flatter back surface is obtained. By wax-mounting and polishing the above half-polished wafer, excellent flatness can be obtained.

Another effect of half-polishing the back surface of a wafer, in particular, a wafer with polysilicon film, is a noticeable decrease of particles during the succeeding process and during wafer transportation. This effect is supposed to reduce the breakage of protrusions or mounds and also reduce the peeling off of peaks of ripples or films by smoothing the back surface of the wafer. It is obvious that these effects are similar in the device manufacturing process.

The same effects appear in wafers polished on both sides (both sides polished simultaneously by a double side polishing machine). However, a wafer polished on both sides is not used because the back surface easily becomes dirty or scratched. Recently, it has been discovered that the contaminants adhering to the back surface are harmful when they migrate to the front surface and degrade submicron devices. Furthermore, misalignment of the back surface which may occur because it is difficult to distinguish the front surface from the back surface, may be overcome by optically distinguishing the mark on the front surface. It is therefore necessary to procure wafers polished on both sides.

However, important disadvantages appear during the photolithography process. It is obvious that the flatness of the vacuum chuck must be improved in order for highly integrated circuits to be sufficiently flat on the front surface to satisfy a shallow focus. Consequently, extremely flat surfaces are in contact with each other, strong adhesion occurs due to van der Waals forces, and it often happens that air cannot be completely eliminated, resulting in the formation of air bubbles between the chuck and the back surface. On the front surface, mounds appear above the location of air bubbles and deteriorate flatness in a manner similar to that when wafer flatness is poor. Furthermore, it becomes difficult to dismount the wafer from the vacuum chuck. To overcome these difficulties, it is necessary to construct complicated chuck structures having many vacuum holes and to slowly remove air from the inner portion to the outer portion. This considerably reduces the throughput of device production.

In contrast, a wafer provided with a half-polished back surface is almost of the same reflectivity as one having an etched surface, and is easily distinguished by the unaided eye. During lithography, the half-polished back surface is similar to an as-etched back surface because the troughs of the ripples function as conduits to allow the passage of air. There are therefore no difficulties during vacuum chucking and removal from the chucking. In view of the above, a wafer having a half-polished back surface has advantages similar to those of a wafer polished on both sides.

As described above, the half-polishing operation which involves eliminating mounds and cutting peaks of the ripples should be carried out in order to manufacture a large-diameter wafer exhibiting an excellent flatness. However, the constructions of any conventional wafer-polishing apparatuses are unsuited to such an operation.

SUMMARY OF THE INVENTION

It is therefore a primary object of the present invention to provide a wafer-polishing apparatus which is suitably used to manufacture a large-diameter wafer which meets the strict requirements on the flatness.

More specific object of the invention is to provide a wafer-polishing apparatus which can be used to reduce not only the occurrence of the dimple defects on the surface of the wafer but also the generation of the debris particles after the polishing step, and which further reduces wave defects on a Makyo level.

According to the present invention, there is provided an apparatus for polishing a wafer, comprising:

a lower polishing plate assembly having an axis of rotation and dimensioned to have an outer diameter of at least twice the wafer, the lower polishing plate assembly including a lower polishing plate defining a polishing position on an upper surface thereof and having a fluid passageway formed therein for flowing cooling water, a polishing pad secured to the upper surface of the lower polishing plate, a porous sheet of a thickness of 0.5 to 3 millimeters formed of a foaming resin and interposed between the lower polishing plate and the polishing pad, and a circulating means attached to the lower polishing plate for supplying the cooling water to the fluid passageway;

a first rotating mechanism attached to the lower polishing plate assembly for rotating the lower polishing plate assembly about the axis of rotation;

an upper polishing plate assembly including, an upper polishing plate having an axis of rotation and disposed generally parallel to the lower polishing plate so as to be opposed to the polishing position on the lower polishing plate, the upper polishing plate having a vacuum passageway formed therein so as to open to a lower surface thereof, a plate-like chuck secured to the lower surface of the upper polishing plate and a backing pad secured to the chuck, each of the chuck and the backing pad having a plurality of apertures communicated with the vacuum passageway, a pressure reducing means attached to the lower polishing plate for reducing pressure in the vacuum passageway, and a cleaning means attached to the upper polishing plate for blasting a cleaning water containing gas into the vacuum passageway to clean the chuck and the backing pad;

a second rotating mechanism attached to the upper polishing plate assembly for rotating the upper polishing plate assembly about the axis of rotation, the second rotating mechanism including a supporting mechanism for permitting the rotation of the upper polishing plate for tilting movement;

a pressing mechanism for pressing the upper polishing plate assembly against the lower polishing plate assembly;

a conveying mechanism for bringing the wafer onto a respective polishing position; and a discharging mechanism for discharging the polished wafer from the polishing position.

The lower surface or the chuck may be defined by a convexly curved surface which has a central portion protruding downwards so that a radius of curvature ranges from 100 to 1000 meters.

In the above apparatus, the polishing pad is disposed on the upper surface of the lower polishing plate through the foaming resin sheet interposed therebetween, the resin sheet of 0.5 to 3 mm thickness having a great number of through pores. Therefore, the resin sheet is pressed by the wafer and deformed elastically in such a manner that that portion opposing to the wafer sinks while a portion of a prescribed width extending outwardly from the outer periphery around the opposing portion is recessed smoothly. Accordingly, the amount of depression can be made larger compared with the case where the polishing pad is directly secured to the upper surface of the lower polishing plate, and even protrusions and mounds of the wafer such as smooth ripples can be pressed strongly, so that the half-polishing (chemical mechanical polishing) can be facilitated. Therefore, the protrusions and mounds are polished off, and the peaks of the upper portions of the ripples are cut, thereby improving the flatness of the wafer.

In the foregoing, the lower surface of the chuck secured to the lower surface of the upper polishing plate assembly may be formed by a curved plane having a central portion which is convex in a downward direction. In such a case, the abutting pressure of the polishing pad can be made equal between the periphery of the wafer and the center of the wafer, so that the undue polishing of the peripheral portion can be avoided.

DESCRIPTION OF THE PREFERRED EMBODIMENT OF THE INVENTION

Figure 13:
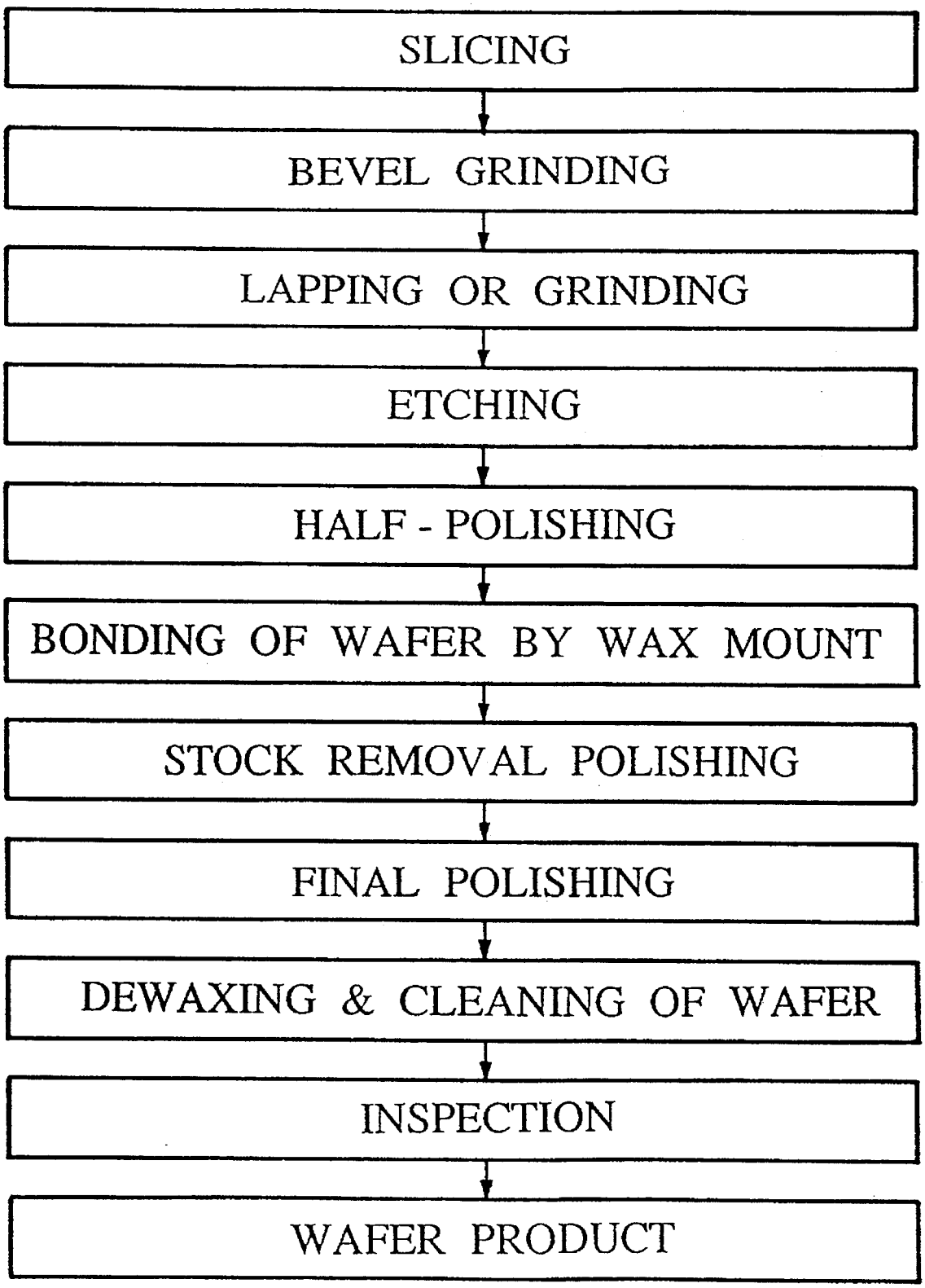
FIG. 13 is a flow diagram showing a wafer manufacturing method.

FIG. 13 depicts a flow diagram showing a wafer manufacturing method developed by the same applicants. In this method, a silicon single crystal ingot of a cylindrical shape is sliced into thin disc-shaped wafers, and the periphery of each wafer is subjected to bevel grinding. The wafer is then placed on a lapping machine, and both surfaces thereof are lapped with loose abrasive particles. Thereafter, the wafer is immersed in an etchant to remove damaged layers caused on its both surfaces during the lapping or grinding operations. The etching amount at this time is set to such a thickness that the damaged layers on the both surfaces of the wafer can be completely removed, that is, usually to about 20 μm for each side. Subsequently, the back surface of the wafer is subjected to a chemical mechanical polishing to half-polish the same. More specifically, the back surface of the wafer is polished by bringing the back surface into abutment with a rotating polishing pad while supplying an alkaline polishing liquid containing fine polishing particles such as colloidal silica ($SiO_2$). After the completion of the half-polishing, the wafer is subjected to mirror polishing which involves stock-removal polishing and final polishing operations. Subsequently, after being cleaned and dried, the wafer is subjected to a prescribed quality inspection to obtain a wafer product.

The wafer-polishing apparatus of the present invention is particularly suitable for performing the half-polishing operation in the aforesaid wafer-manufacturing process.

Figure 1:
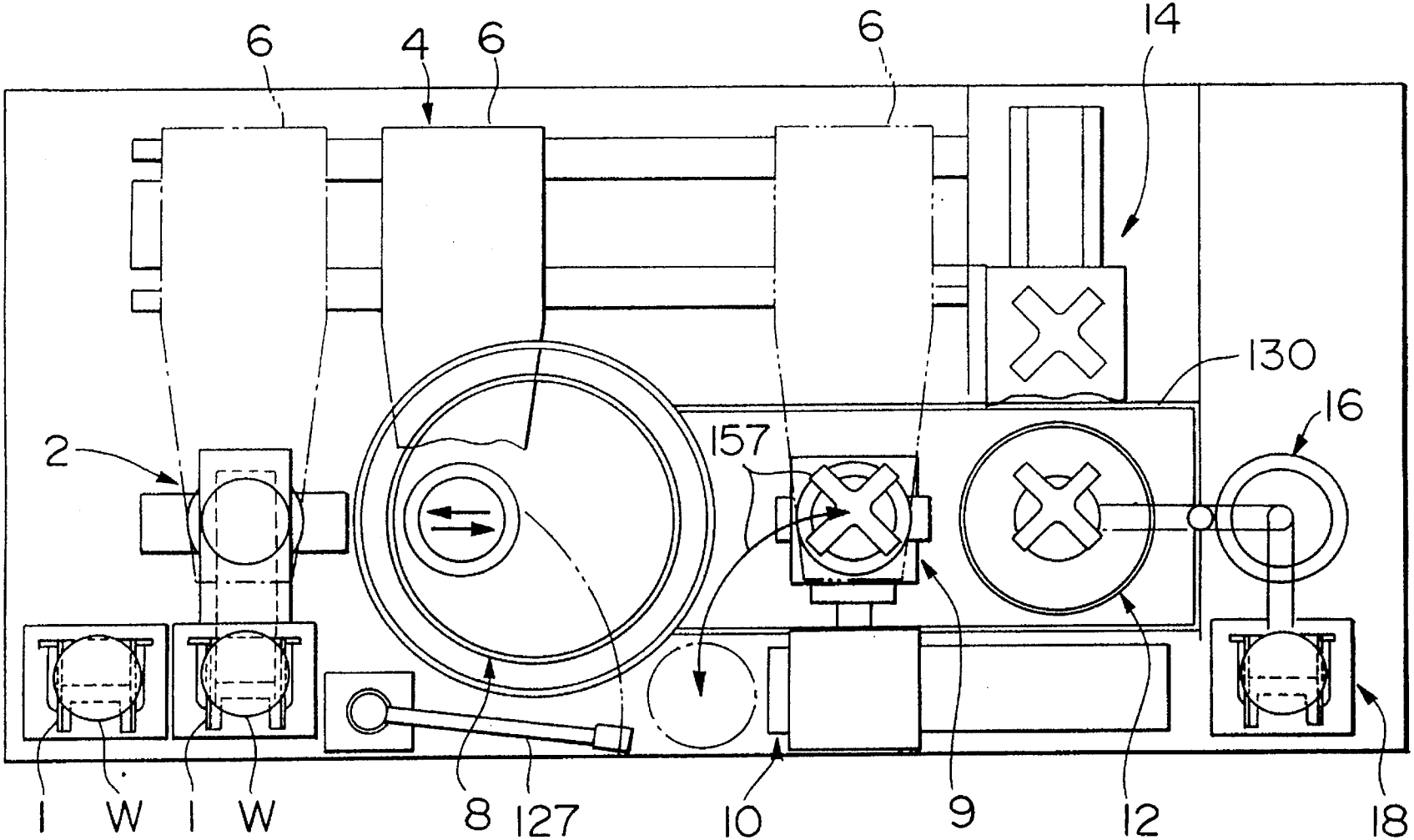
FIG. 1 is a plan view of a wafer-polishing apparatus in accordance with the present invention.

Referring to FIG. 1, the wafer-polishing machine in accordance with an embodiment of the invention will first be described briefly. The numerals 1 denote wafer cassettes each constructed to receive a large number of wafers W horizontally laid one below the other with a prescribed spacing being maintained between the adjacent wafers. The wafers W accommodated in each wafer cassette 1 are picked out one by one by a wafer pick-up mechanism 2 and held by vacuum on an upper polishing plate assembly 6, which is on standby in a conveying mechanism 4.

The upper polishing plate assembly 6 is constructed to hold the wafer W by vacuum and move on a polishing mechanism 8. The polishing mechanism 8 includes a lower polishing plate assembly, and the wafer W is subjected to single side polishing while being sandwiched between the upper and lower polishing plate assemblies. After the completion of the polishing, the upper polishing plate assembly 6 holds the wafer W by vacuum and moves to a position opposing to a preliminary cleaning mechanism 9, and sets the wafer down on a wafer receiver of a rotary-conveying mechanism 10 by releasing the vacuum chucking. Those portions of the preliminary cleaning and rotary-conveying mechanisms 9 and 10 which receive the wafer, as well as the wafer which is soiled by the polishing liquid and polishing debris, are cleaned with a cleaning water.

After the cleaning of wafer, the rotary-conveying mechanism 10 picks up the wafer W, turns it over, and conveys it onto a spinning mechanism 12, which includes a brushing mechanism 14 for carrying out cleaning by brush. The wafer W is held on a rotary table of the spinning mechanism 12 with its back surface not to be polished being adhered thereto. The brushing mechanism 14 is driven to approach the adhered wafer W to blast a detergent or cleaning water against the wafer W through a nozzle. The brushing mechanism 14 is also provided with a pair of downwardly directed brushes, which are brought into contact with the polished surface of the wafer W and rotated to remove the particles on the polished surface.

After the cleaning by brush is completed, the spinning mechanism 12 dries the wafer W by rotating the wafer at high speed to remove the cleaning water by centrifugal force. The dried wafers W are successively picked up by a discharging robot 16 and received in a wafer-housing mechanism 18.

Next, each mechanism or component of the aforesaid polishing apparatus will be described in more detail.

Figure 2:
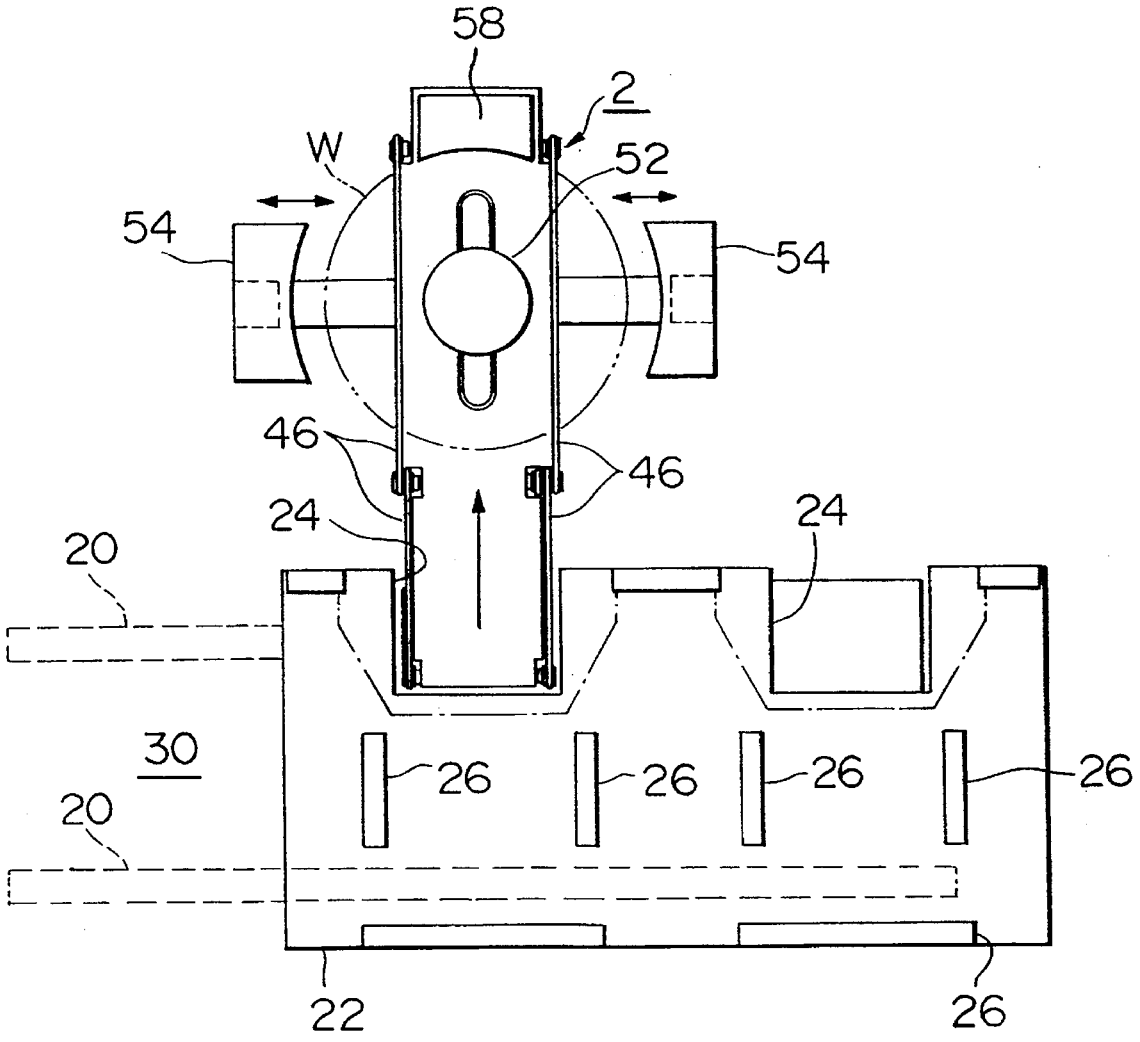
FIG. 2 is a plan view of the apparatus of FIG. 1, showing a mechanism for picking-up wafers.
Figure 3:
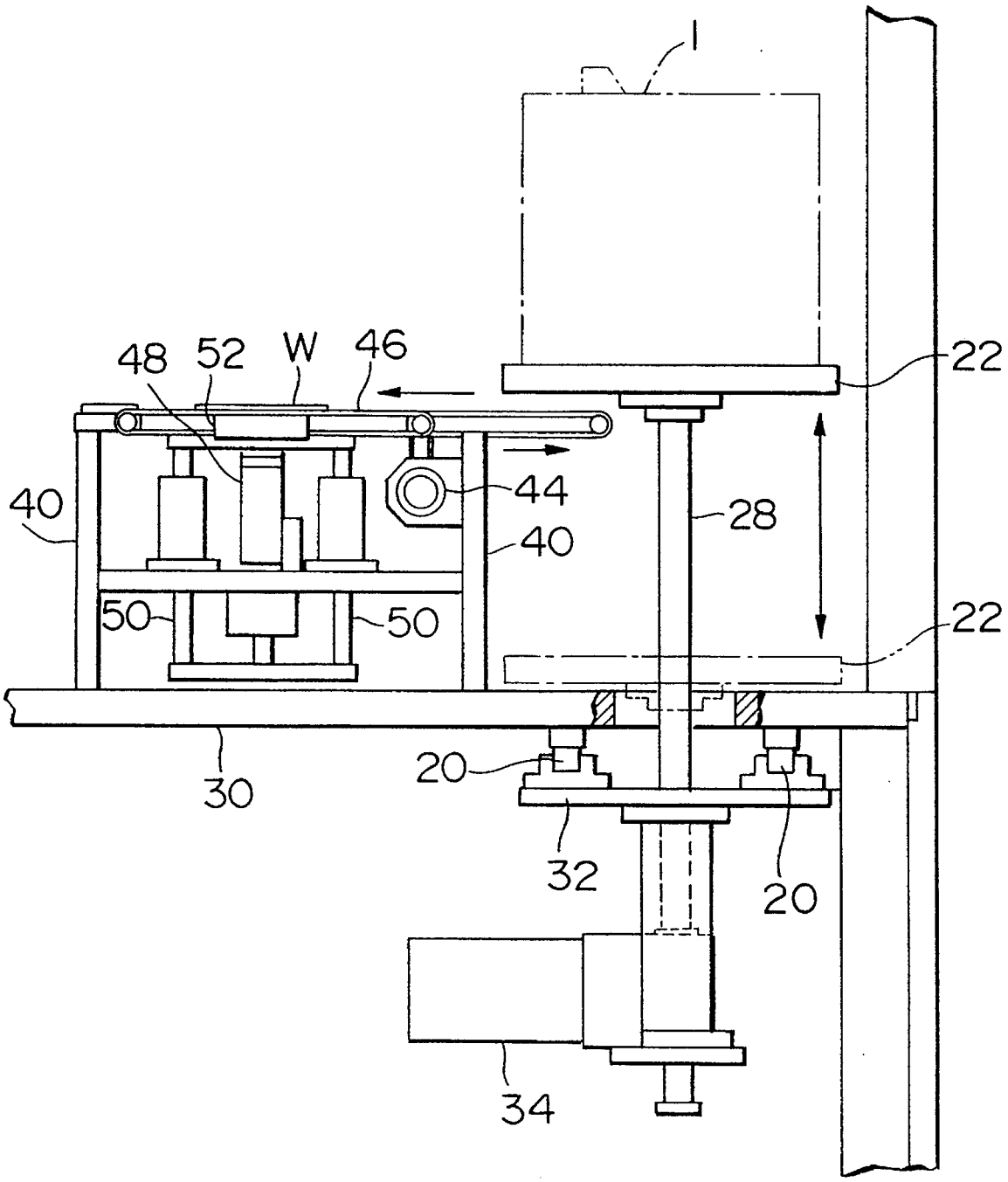
FIG. 3 is a side elevational view of the wafer pick-up mechanism of FIG. 2.
Figure 4:
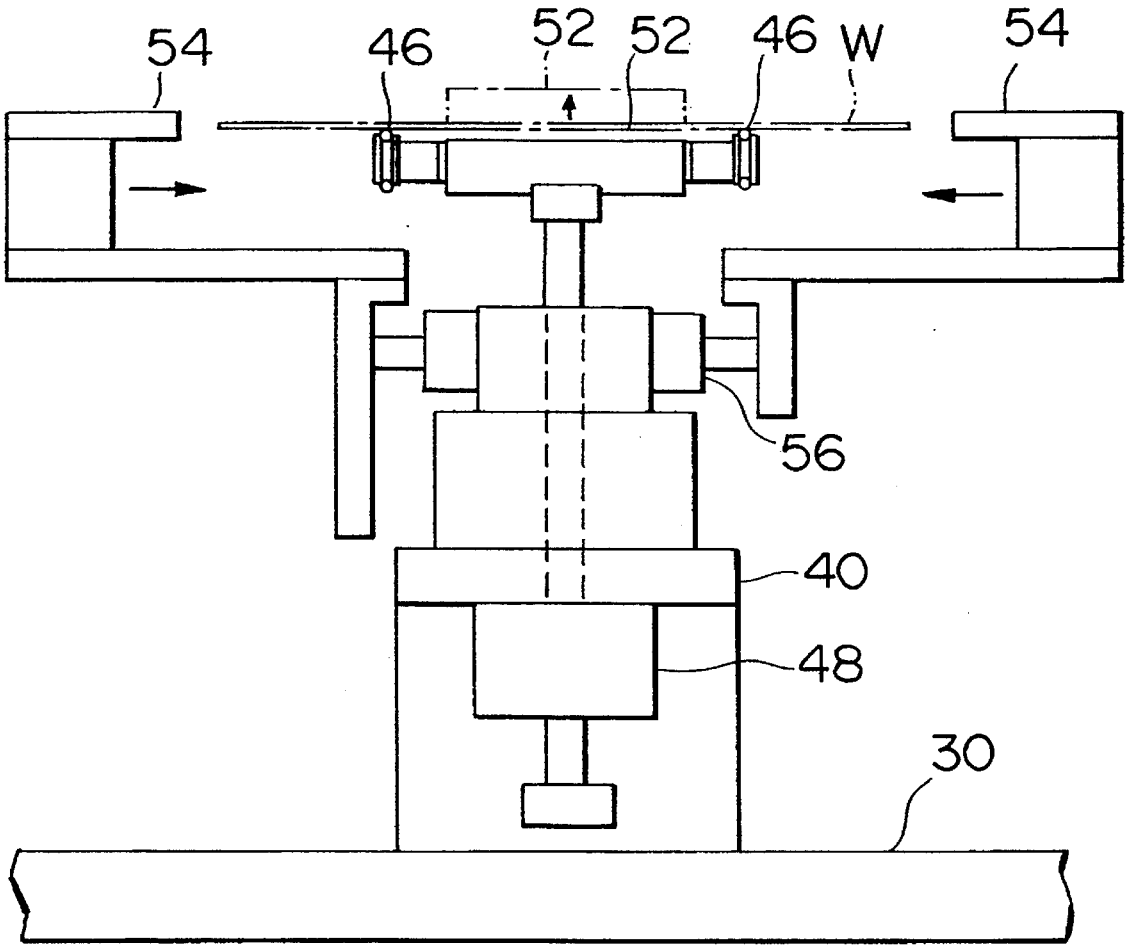
FIG. 4 is a partially cut-away side elevational view showing an essential part of the wafer pick-up mechanism of FIG. 2.

FIGS. 2 to 4 depict the wafer pick-up mechanism 2, in which as best shown in FIG. 3, a pair of parallel rails 20 are fixedly secured to a lower surface of a base 30, and a mobile support 32 is attached to the rails 20 for sliding movement therealong. A vertical shaft 28, which extends through the base 30 to protrude upwards therefrom, is mounted on the mobile support 32 for vertical movement, and a drive motor 34 is attached to the mobile support 32 for moving the vertical shaft 28 up and down.

A cassette pedestal 22 is fixedly secured in a horizontal manner to an upper end of the vertical shaft 28. As shown in FIG. 2, the cassette pedestal 22 is dimensioned such that two wafer cassettes can be vertically placed thereon, and includes two pairs of engaging protrusions 26 for holding the two wafer cassettes 1. One side of each wafer cassette 1 is formed open such that the wafers W can be inserted thereinto and removed therefrom, whereas the cassette pedestal 22 is further provided with a pair of cut-outs 24, each formed at a prescribed position corresponding to the opening side of the wafer cassette.

Furthermore, as shown in FIG. 2, a pair of conveyor belts 46 are arranged in opposed relation to one of the cut-outs 24. As shown in FIG. 3, these conveyor belts 46 are horizontally supported by supporting members 40 which are fixedly mounted on the base 30, and a drive motor 44 is fixedly secured to the supporting members 40 for driving the conveyor belts 46 to cause the upper sides thereof to travel in a direction for picking up the wafer from the wafer cassette 1. Thus, when the wafer cassette 1 is lowered stepwise while traveling the conveyor belts 46, the wafers W received in the wafer cassette 1 are successively brought into contact with the conveyor belts 46, and picked out from the wafer cassette 1 onto the conveyor belts 46.

Arranged at the terminal end of the conveyor belts 46 is a stopper 58 which stops the conveyed wafer W. In addition, a vertically movable push-up member 52 is arranged at a position corresponding to the center of the stopped wafer. As shown in FIGS. 3 and 4, the push-up member 52 is supported by guide rods 50 vertically movably secured to the supporting members 40, and a cylinder device 48 for moving the guide rods 50 vertically is securely fixed to the supporting members 40.

As shown in FIG. 2, a pair of openable and closable holding claws 54 are arranged adjacent the outer periphery of the stopped wafer W in diametrically opposite relation to each other. As shown in FIG. 4, these claws 54 are secured to opposite rods of a twin cylinder device 56 which is horizontally arranged and securely fixed to the supporting member 40, whereby the actuation of the twin cylinder device 56 causes the claws 54 to be closed to thereby hold the wafer W horizontally to effect its centering.

Figure 5:
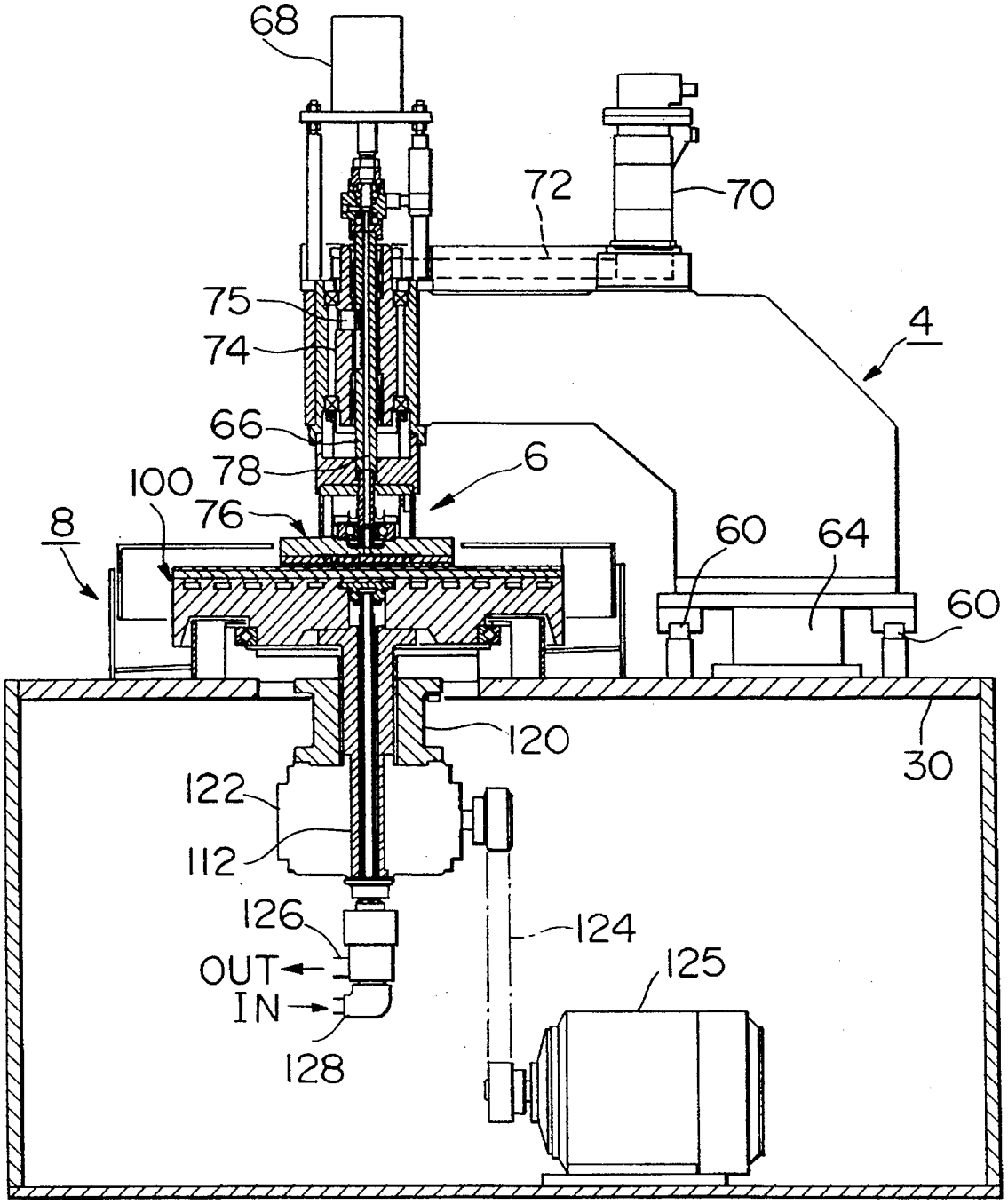
FIG. 5 is a cross-sectional view showing conveying and polishing mechanisms of the polishing apparatus of FIG. 1.

Next, FIG. 5 depicts the conveying mechanism 4 as well as the polishing mechanism 8. In the conveying mechanism 4, a pair of parallel linear guides 60 are arranged on the base 30, and an L-shaped body portion of the upper polishing plate assembly 6 is arranged on the guides 60 so as to be movable therealong. An annular sleeve 74 is mounted at a forward end of the body portion of the upper polishing plate assembly 6 for rotation about a vertical axis thereof, and an upper polishing shaft 66 is inserted into and supported by the sleeve 74 so as to extend vertically.

The sleeve 74 and the upper polishing shaft 66 are constructed so as to be vertically movable relative to each other, but their relative rotation is prevented by means of a key 75 inserted therebetween. The upper end of the sleeve 74 is connected to a rotating shaft of a drive motor 70 through a belt 72, whereby the sleeve 74 and the upper polishing shaft 66 are forcibly rotated. In addition, a vacuum passageway 78 is axially formed in the upper polishing shaft 66, and a pressure reducing means PR is connected to the upper end of the upper polishing shaft 66 for reducing the pressure in the passageway 78. The vacuum passageway 78 also serves as a fluid passage for injecting air-containing cleaning water against a disc-shaped chuck 84 and a backing pad 84B to clean the same, and a cleaning means C is attached to the lower polishing plate for blasting the air-containing water Into the vacuum passageway.

Figure 6:
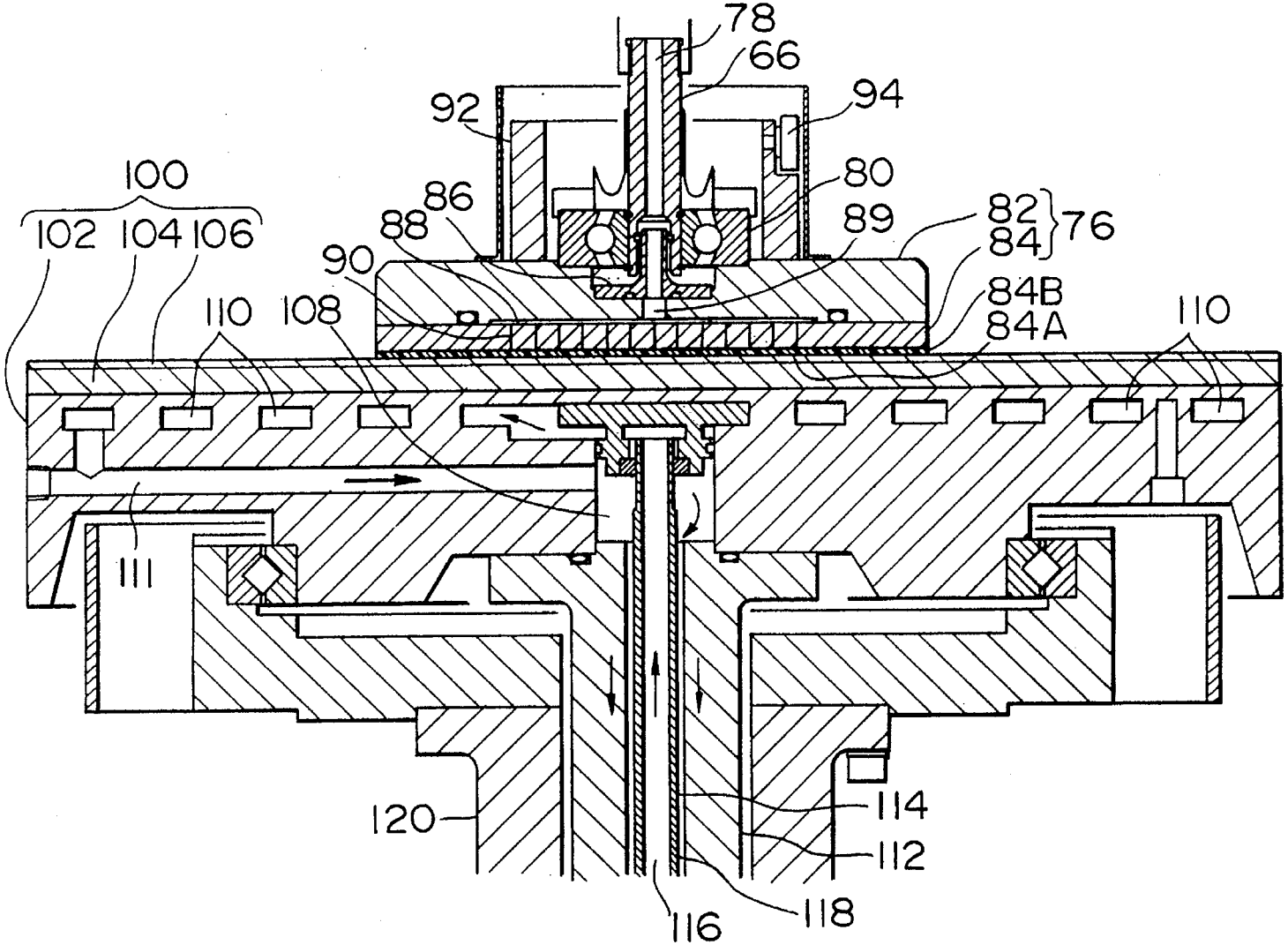
FIG. 6 is a cross-sectional view of the polishing mechanism of FIG. 5.

As shown in FIG. 6, a disc-shaped top ring 76 is horizontally secured to the lower end of the upper polishing shaft 66. The top ring 76 serves as one element which partly constitutes both the conveying mechanism 4 and the polishing mechanism 8. The top ring 76 comprises an upper polishing plate 82, the disc-shaped chuck 84 fixedly secured to the lower surface of the plate 82, and the backing pad 84B, and the upper polishing plate 82 is secured to the lower end of the upper polishing shaft 66 through a universal joint 80 for pivotal movement.

A lower shallow recess 88 of a circular shape having substantially the same diameter as the wafer W is formed in the lower surface of the upper polishing plate 82 whereas an upper circular recess of a reduced diameter is formed in the upper surface thereof, and an aperture 89 communicated with the recess 88 and opening to the upper recess in the upper surface of the upper polishing plate 82 is formed in the polishing plate 82. In addition, an elastic tube 86 is accommodated in the upper recess so as to be positioned between the aperture 89 and the lower end of the upper polishing shaft 66, whereby the vacuum passageway 78 formed in the upper polishing shaft 66 is sealingly communicated with the lower recess 88 through the tube 86.

Furthermore, a stopper ring 92 is securely fixed on the upper surface of the upper polishing plate 82 so as to be coaxially therewith, and a plurality of sheaves 94 are rotatably mounted on the upper end of the stopper ring 92. With this construction, when the upper polishing shaft 66 is elevated, the sheaves 94 are brought into rolling abutment with a part of an arm of the upper polishing plate assembly 6 to regulate the position of the top ring 76.

That portion of the chuck 84 which is opposed to the recess 88 is formed of a porous ceramic having a great number of thin apertures 90 dispersed from one another. The lower surface of the chuck 84, that is, the surface 84A held in contact with the backing pad 84B, is formed by such a convexly curved surface that its central portion protrudes in a downward direction, and the radius of curvature of the curved surface is 100 to 1,000 m while the height of the central portion is from 5 to 20 micrometers for an 8 inch crystal. Within this range, the surface comes to substantially conform to the sinking amount of a polishing pad 106, which will be described later. Therefore, the polishing amount of the wafer W is made uniform.

The backing pad 84B, which is secured under the chuck 84, is formed of a porous polyurethane so as to have a high friction coefficient and a thickness of 1 mm, and is similar to the one usually utilized in waxless polishing. The wafer is held on the lower surface of the backing pad 84B by vacuum, and when polishing the wafer, vacuum is released and the wafer is polished while being adhered with water. After the completion of the polishing, the wafer is again held on the chuck by vacuum. Since this polishing is a final polishing, the load exerted is small, so that the wafer is prevented from being rotated although it is adhered with water.

Next, the peripheral construction of the lower polishing plate assembly 100 of the polishing mechanism 8 will be described. The lower polishing plate assembly 100 includes a lower polishing plate 102, a sheet 104 fixedly secured to the upper surface of the lower polishing plate 102, and a polishing pad 106 adhered onto the sheet 104. The outer diameter of the lower polishing plate assembly 100 is set to twice that of the wafer W, and the top ring 76 is constructed so that when it is in a polishing position, it is opposed in parallel relation to that portion of the lower polishing assembly 100 other than the central portion.

A central aperture 108 is formed in the lower polishing plate 102, and a groove 110 extending spirally from the central aperture 108 towards the outer periphery is formed on the entire upper surface of the lower polishing plate 102. Further, a cooling-water return passageway 111 returning from the outer peripheral end to the central aperture 108 is formed in the lower polishing plate 102.

A lower hollow polishing shaft 112 is secured to the lower surface of the lower polishing plate 102, and a cooling-water pipe 114 of a smaller-diameter is inserted in and coaxially arranged with the lower polishing shaft 112. Defined between the inner peripheral surface of the lower polishing shaft 112 and the outer peripheral surface of the cooling-water pipe 114 is a return passageway 118 which is communicated with the return passageway 111 through the central aperture 108. Moreover, a cooling water passageway 116 defined in the cooling-water pipe 114 is only communicated with The inner end of the spiral groove 110 formed in the upper surface of the lower polishing plate 102. Thus, cooling water, supplied through the cooling-water passageway 116 from a constant-temperature cooling-water bath, removes the polishing heat accumulated in the sheet 104 and the polishing pad 106 to maintain at the constant temperature, thereby preventing variation of The polishing conditions.

As shown in FIG. 5, a speed change gear 122, which is supported by a spacer 120 securely fixed to the base 30, is connected to a downward portion of the lower polishing shaft 112, and a motor 125 is drivingly connected to the input shaft of the change gear 122 through a belt 124, whereby the lower polishing plate assembly 100 is rotated by The motor 125.

A discharge tube 126, which is communicated to the afore-said return passageway 118, as well as a cooling-water tube 128, which is communicated with the cooling-water passageway 116, are securely fixed to the lower end of the lower polishing shaft 112 through rotary seals (not shown), and constant-temperature cooling water is introduced through the cooling-water tube 128, removed from the discharge tube 126, and returned to the constant-temperature cooling-water bath.

Referring again to FIG. 6, the polishing pad 106 defining the upper surface of the lower polishing plate assembly 100 may be conventional pads which have been used in conventional wafer-polishing machines, and more particularly a nonwoven fabric polishing pad sold under the trade name of "Seagal 7355" is preferable. Furthermore, the sheet 104, which is one of the features of the present invention, is a sheet material of foaming resin which is 0.5 to 3 mm thick and has a great number of through pores. For example, polyurethane foam or foaming rubber is preferable. If the thickness off the sheet 104 is less than 0.5 mm, there will be no significant difference between the polishing amounts of the protruding portions and those of the recessed portions. On the other hand, if the thickness exceeds 3 mm, the amount of depression of the polishing pad becomes excessive, and the abutting force of the polishing pad 106 onto the wafer W is susceptible to variation, resulting in unevenness in the polishing amount.

Moreover, as shown in FIG. 1, a jet nozzle 127 which is disclosed in Japanese Patent Application, Laid-Open Publication No. 3-10769, is arranged adjacent to the preliminary cleaning mechanism 9. With this mechanism, when the upper polishing plate assembly 6 is elevated, the jet nozzle 127 blasts a high-pressure water towards the polishing pad to remove the foreign matters or polishing debris thereon and dress the polishing pad to keep stable polishing conditions.

Figure 7:
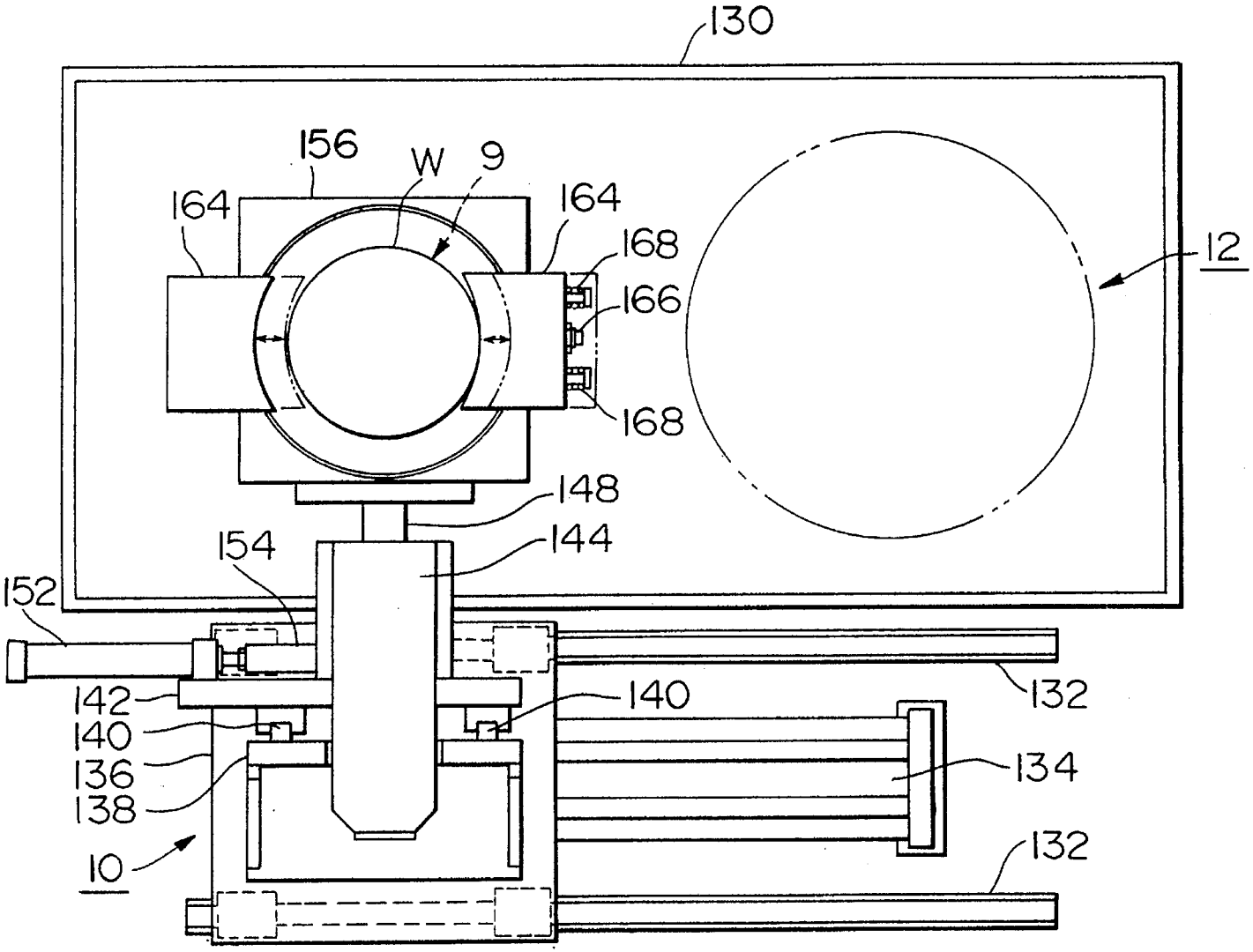
FIG. 7 is a plan view of the polishing apparatus of FIG. 1, showing a rotary conveying mechanism thereof.

Subsequently, the preliminary cleaning mechanism 9 as well as the rotary-conveying mechanism 10 will be described with reference to FIGS. 7 and 8. A box-shaped water pan 130 (see FIG. 1) is mounted on the base 30 so as to be arranged adjacent to the polishing mechanism 8. As shown in FIG. 7, a pair of parallel guide rails 132 are horizontally disposed adjacent to the water pan 130, and a mobile support 136 is arranged on the guide rails 132 so as to be movable therealong. A rodless cylinder device 134 is attached to the movable support 136 to drive the same.

In addition, a supporting post 138 is vertically mounted on the mobile support 136, and a pair of parallel guide rails 140 extending in a vertical direction are fixedly secured to the lateral surface of the supporting post 138. Furthermore, a lifting plate 142 is secured to the rails 140 so as to be movable up and down therealong. A support plate 144 is securely fixed to the upper end of the lifting plate 142, and a cylinder device 146 for moving the support plate 144 up and down is securely fixed to the mobile support 136.

Horizontally secured to the lifting plate 142 and the support plate 144 for rotation is a reversing shaft 148 which extends to a position above the water pan 130 and is provided with a wafer-holding member 156 of a rectangular plate shape horizontally secured to its distal end. As shown in FIG. 8, a pinion 150 is secured to the proximal end of the reversing shaft 148, and, as shown in FIG. 7, a rack 154 is held in engagement with the pinion 150. In addition, a cylinder device 152 is securely fixed to the lifting plate 142 for moving the rack 154 in its longitudinal direction, whereby when the cylinder device 152 is actuated, the wafer-holding member 156 makes a half turn so that the surfaces are reversed.

Figure 8:
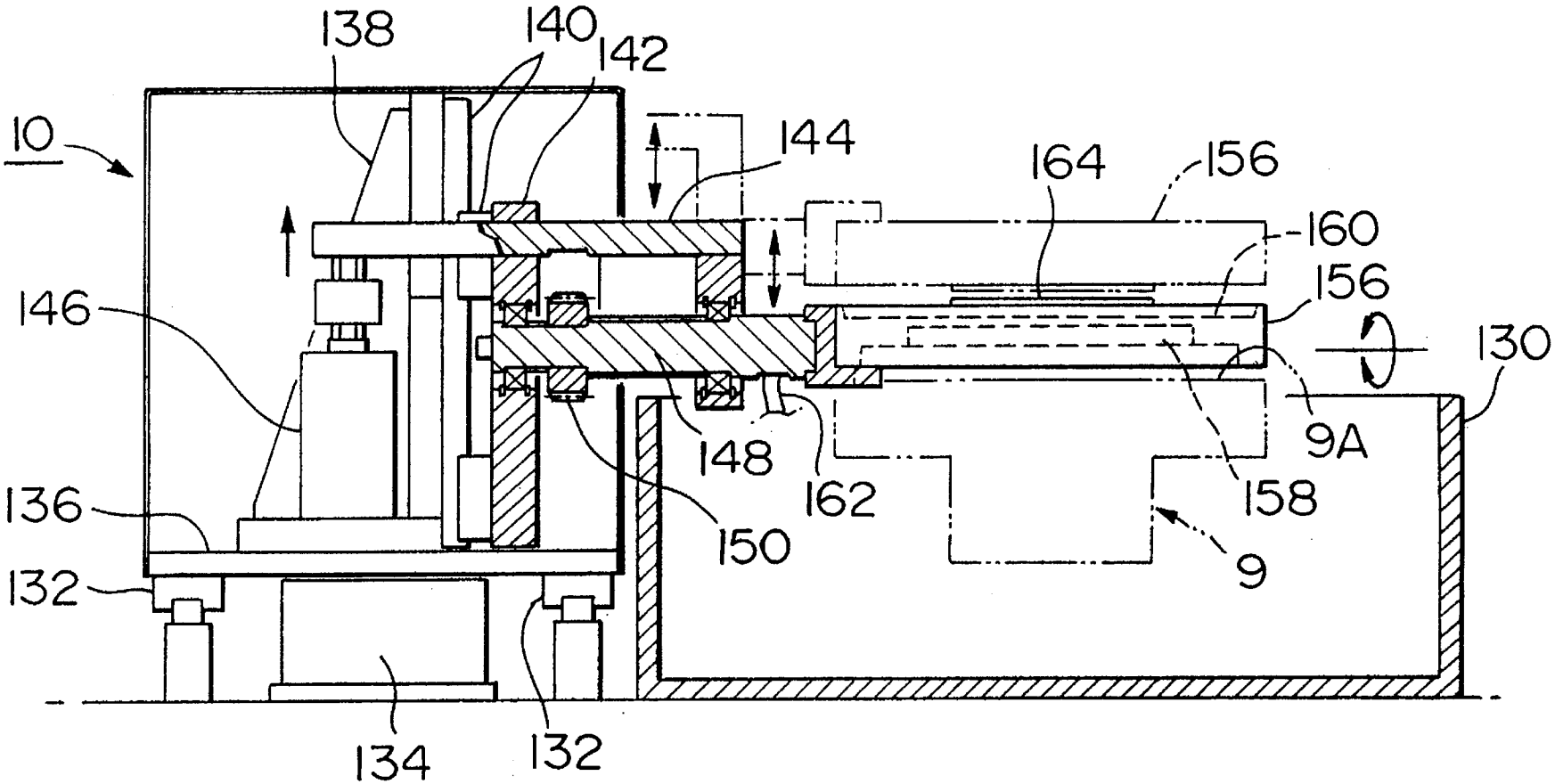
FIG. 8 is a side elevational view of the rotary conveying mechanism of FIG. 5.

As shown in FIG. 8, a circular wafer recess 160 of a size capable of accommodating the wafer W is formed in one side of the wafer-holding member 156. Furthermore, a hollow portion 158, which is communicated with the recess 160 through a number of small apertures (not shown), is formed in the wafer-holding member 156, and the hollow portion 158 is connected to a cooling-water jet means through the cooling-water passageway formed in the reversing shaft 148 and a tube 162 connected to the reversing shaft 148, whereby the preliminary cleaning of wafers as well as the cleaning of the wafer recess 160 and a pair of engaging claws 164 are performed to prevent any soils caused by the polishing liquid.

Moreover, the pair of engaging claws 164 are symmetrically secured to the opposite right and left ends of the wafer-holding member 156. The engaging claws 164 are urged in an opening direction, i.e., in a direction away from each other, by a spring 168, and are adapted to be driven in a closing direction by cylinder devices 166. Thus, when the cylinders 166 are activated, the engaging claws 164 are closed to hold the outer periphery of the wafer W therebetween.

The preliminary cooling mechanism 9 is, as shown in FIG. 8, provided with a circular jet nozzle 9A directed towards the lower surface of the wafer-holding member 156. The jet nozzle 9A is dimensioned such that its outlet has a diameter generally equivalent to the wafer-holding member 156, and is positioned in such a place that a prescribed spacing is maintained with respect to the wafer-holding member 156 in a descent position. Thus, the cleaning water is overflowed from the jet nozzle 9A to clean the wafer W which is kept horizontally in the wafer-holding member 156. The cleaning water used to clean the wafer W drops in the water pan 30 and is discharged away.

Moreover, as shown in FIG. 1, a brush 157 for cleaning the wafer-holding member 156 is retractably arranged adjacent to the rotary-conveying mechanism 10.

Figure 9:
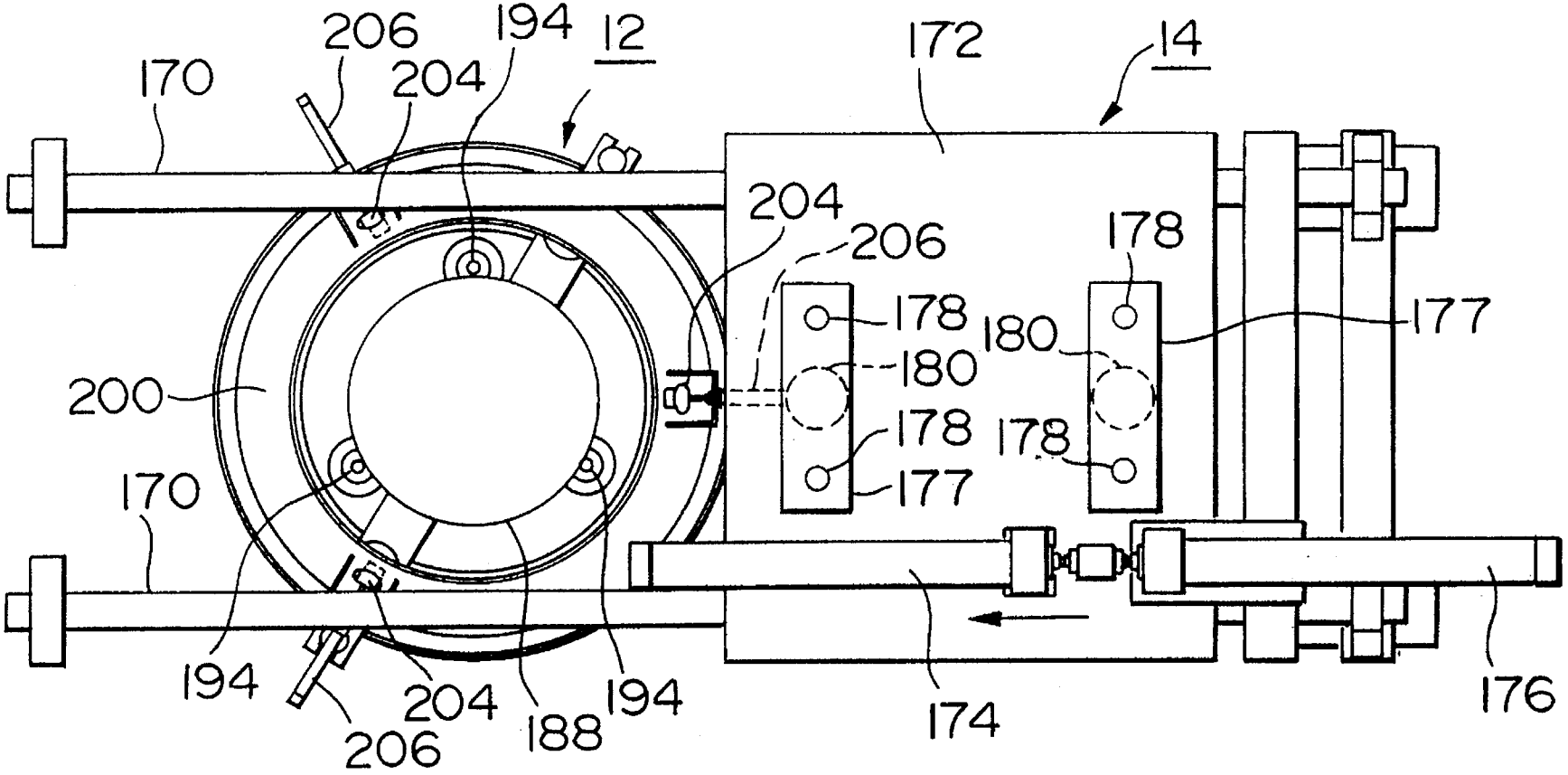
FIG. 9 is a plan view of the polishing apparatus of FIG. 1, showing a brushing mechanism as well as a spinning mechanism thereof.
Figure 10:
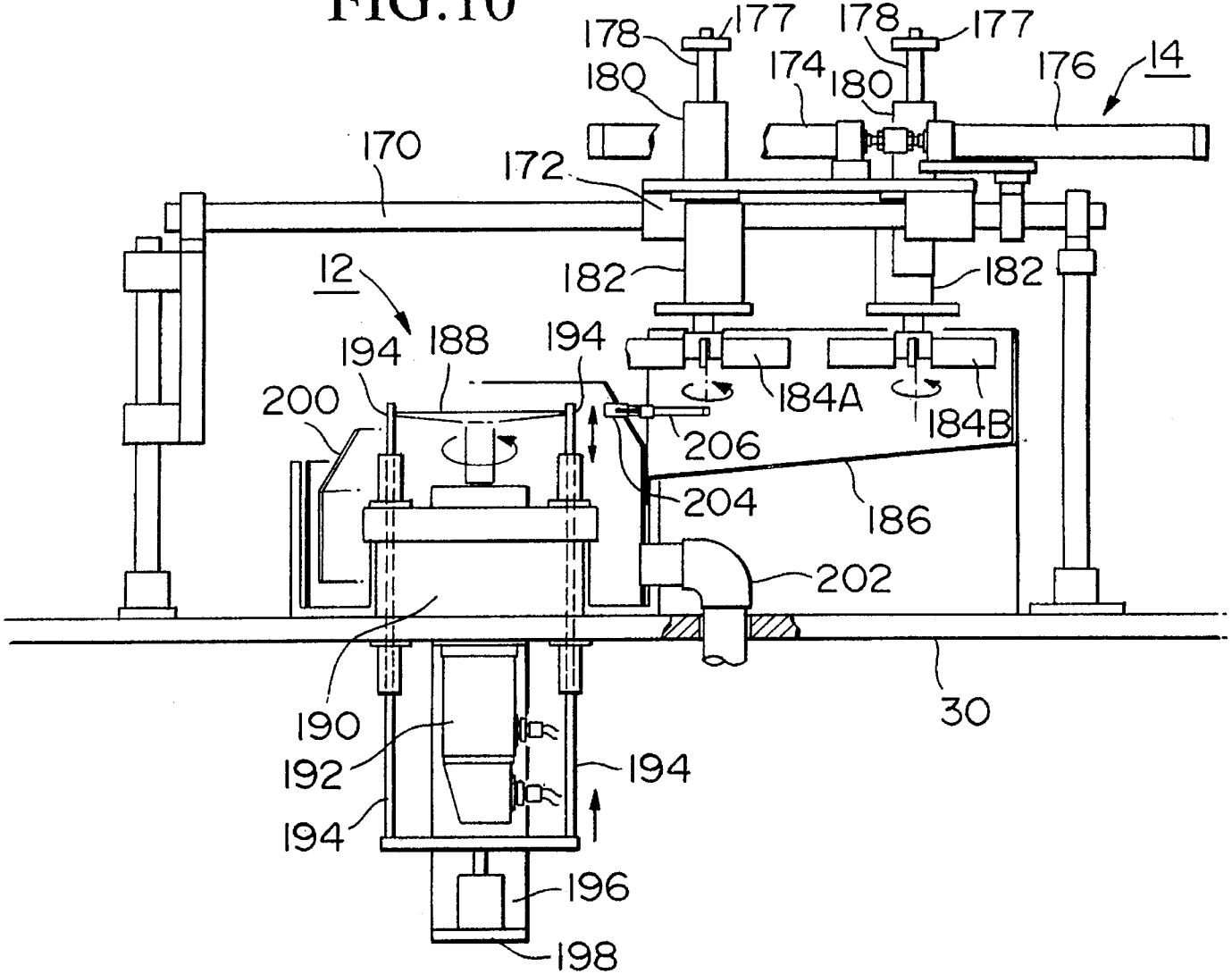
FIG. 10 is a side elevational view showing the brushing and spinning mechanisms of FIG. 9.
Figure 11:
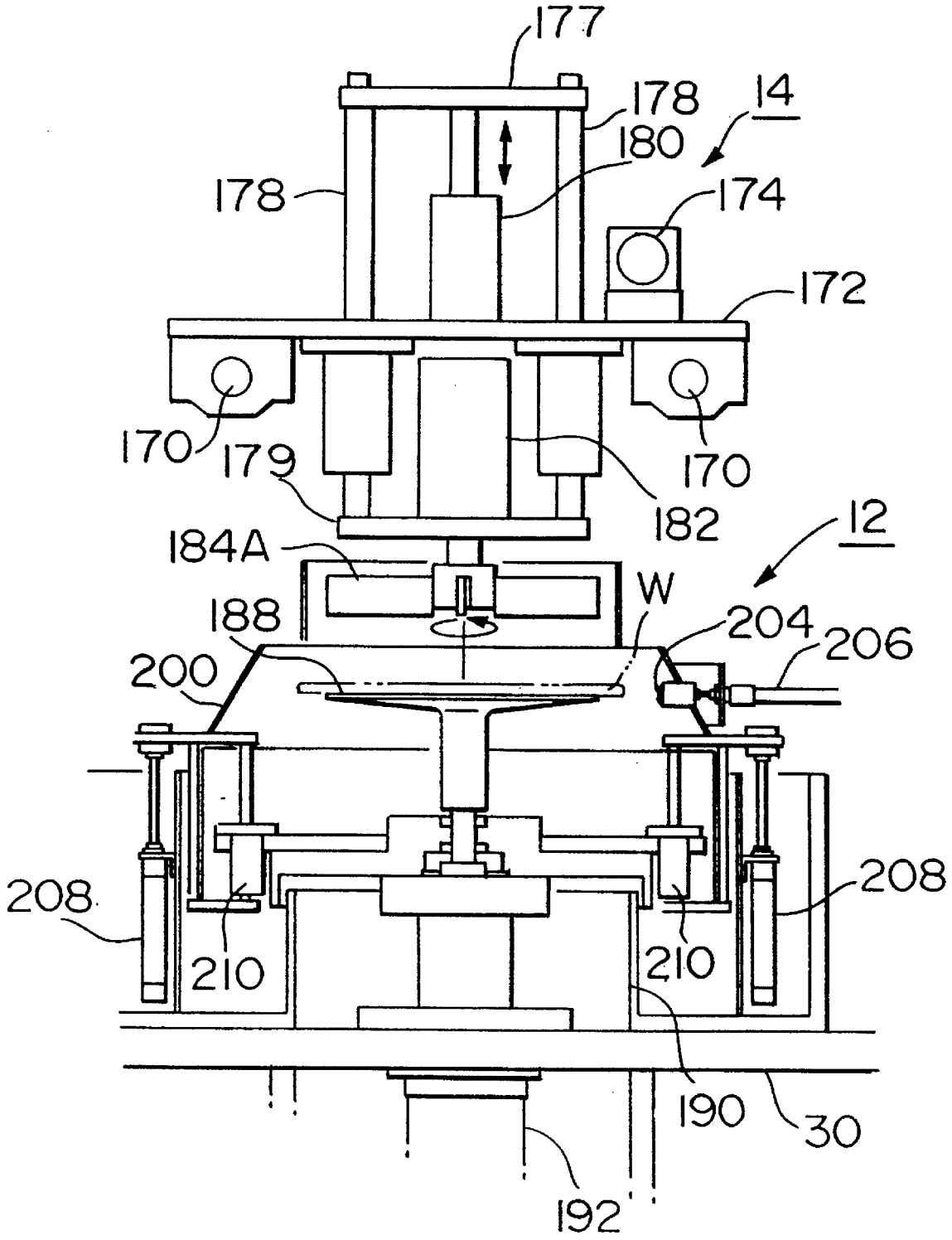
FIG. 11 is a front elevational view showing the brushing and spinning mechanisms of FIG. 9.

FIGS. 9 to 11 depict the spinning mechanism 12 which includes the brushing mechanism 14, FIGS. 9 to 11 being a plan view, a side elevational view and a front elevational view, respectively.

The brushing mechanism 14 is provided with a pair of parallel guide rails 170 horizontally arranged so that one ends thereof extend immediately above the spinning mechanism 12, and a mobile support 172 is movably arranged on the guide rails 170.

A cylinder device 174 is horizontally mounted on the mobile support 172, and its cylinder rod is connected to a rod of a cylinder 176 securely mounted on the guide rails 170 so as to be aligned therewith. Thus, when the cylinders 174 and 176 are activated, the mobile support 172 can be moved along the rails 170 over their entire length.

As best shown in FIG. 1, two pairs of guide rods 178 are attached to and extended vertically through the mobile support 172 so as to be movable up and down, and the upper ends in each pair as well as the lower ends in each pair are connected to each other by upper and lower mounting plates 177 and 179, respectively. A cylinder device 180 is mounted on each of the mobile supports 172 with its rod being directed upwards and connected to a respective upper mounting plate 177, whereby each pair of guide rods 178 are adapted to move up and down by the cylinder device 180.

In addition, a motor 182 is mounted on each of the lower mounting plates 179 with its rotating shaft being directed downwards, and a cruciform brush 184A or 184B is horizontally connected to the rotating shaft. The brushes 184A and 184B are formed of an artificial sponge or the like, and classified into one (brush 184A) for use with detergent and the other (brush 184B) for use with pure water. Thus, by moving the mobile supports 172, both of the brushes 184A and 184B can be retracted from the spinning mechanism 12, or either of the brushes 184A or 184B can be located above the spinning mechanism 12. In addition, as shown in FIG. 10, an inclined launder 186 for discharging cleaning water into the water pan 130 is arranged under the brushes 184A and 184B in their retracted positions.

The spinning mechanism 12 includes a bearing portion 190, a disc-shaped rotary table 188 rotatably and horizontally supported on the bearing portion 190, and a motor 192 for rotating the rotary table 188 at high speed. A vacuum passageway (not shown) is formed in the rotary table 188 so as to open to its upper surface, and a suitable pressure-reducing means (not shown) is connected to the vacuum passageway. Thus, when the pressure-reducing means is operated, the wafer W can be held by vacuum on the upper surface of the rotary table 188.

The outer diameter of the rotary table 188 is slightly smaller than that of the wafer IV, and as shown in FIGS. 9 and 10, three push-up pins 194 are arranged adjacent to the outer periphery of the rotary table 188. As shown in FIG. 10, the push-up pins 194 extend downwards through the bearing portion 190 and the base 30 for vertical movement, and are connected to rods of a cylinder 196 fixedly mounted on the base 30 through a bracket 198. These push-up pins 194 are usually retracted downwards from the upper surface of the rotary table 188, and when the cylinder 196 is activated, the push-up pins 194 push up the outer periphery of the wafer W adhered to the rotary table 188 to remove the wafer W therefrom.

As shown in FIG. 9, a cylindrical cover 200 is arranged so as to coaxially surround the rotary table 188 and supported by guide members 210 for vertical movement. Three cylinders 206, each of which is provided with a pressing member 204 at its rod, are arranged around the outer periphery of the cover 200 in a radial manner with their rods being directed toward the rotary table 188. Thus, when the cylinders 206 are activated concurrently, the centering of the wafer W placed on the rotary table 188 can be carried out.

Figure 12:
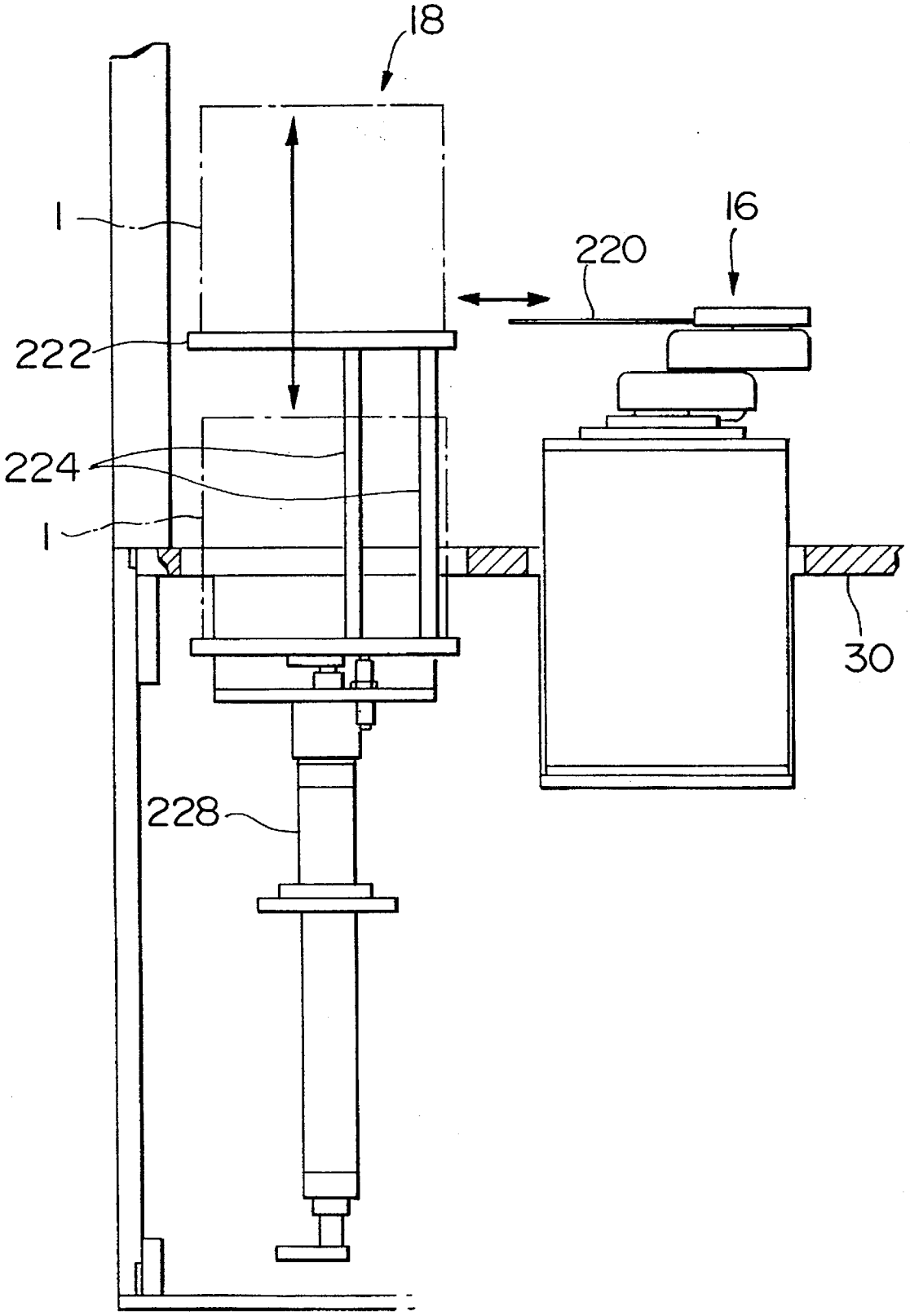
FIG. 12 is a side elevational view of the polishing apparatus of FIG. 1, showing a discharging robot as well as a wafer housing mechanism thereof.

FIG. 12 is a side elevational view showing the discharging robot 16 and the wafer-housing mechanism 18. The discharging robot 16, which is provided with an arm 220 comprised of a horizontally-disposed thin plate, is securedly mounted on the base 30, and is driven to move the arm 220 in a horizontal plane by numerical control. A vacuum passageway (not shown) is formed in the arm 220 so as to open to an upper surface thereof, and a pressure-reducing means is connected to the vacuum passageway, so that the wafer W is held on the arm 220 by vacuum. The discharging robot 16 is programmed so that the arm 220 is inserted along the lower surface of the wafer W, elevated by the push-up pins 194 from the rotary table 188, to hold the wafer W thereon by vacuum, and the wafer W is moved within the wafer cassette of the wafer-housing mechanism which will be described later.

The wafer-housing mechanism 18 includes a cassette table 222 supported by a plurality of vertical rods so as to be movable up and down, and a cylinder device 228 provided under the base 30 for moving the cassette table 222 up and down in a stepwise manner.

In operation, twenty-five wafers W at maximum are set in the wafer cassette 1 with their surfaces to be polished being directed downwards, and the wafer cassette 1 is securely placed on the cassette pedestal 22. As shown in FIG. 2, when the cassette pedestal 22 is gradually descended while rotating the conveyor belts 46 of the wafer pick-up mechanism 2, the conveyor belts 46 are brought into contact with the wafer W to pick up the wafers W one by one.

The wafer W picked up is transferred on the conveyor belts 46 until it abuts the stopper 58, and is sandwiched by the engaging claws 54. Then, the conveyor belt 46 is temporarily stopped to open the engaging claws 54, and the wafer is lifted up by the push-up members 52.

The upper polishing plate assembly 6 is moved above the lifted wafer W, and the top rink 76 is descended in advance and cleaned with aerated pure water, and the lower surface of the backing pad which contains water is brought into abutment with the front surface of the wafer W, to hold the wafer W by vacuum through the vacuum passageway 78. While keeping the wafer W to be adhered on the top ring 76, the upper polishing plate assembly 6 is transferred above the lower polishing plate assembly 100 of the polishing mechanism 8 as shown in FIG. 5, and the wafer W is held between the top ring 76 and the lower polishing plate assembly 100. Thereafter, the holding of the wafer by the upper polishing plate assembly 6 is released, and the wafer W is held by filled water to prevent any dimple defects from occurring due to the vacuum chucking.

The polishing is effected by the chemical mechanical polishing method. For example, while dropping a polishing liquid, which is prepared by diluting colloidal silica (trade name: Compol S) into 1/30 and regulating the pit to 9.8, at a rate of 100 ml/min, the polishing is carried out at a speed of rotation of 100 r.p.m. for the lower polishing plate assembly, a speed of rotation of 90 r.p.m. for the upper polishing plate assembly, a polishing pressure of 300 gf/cm$^2$, such that the upper polishing plate is moved 150 mm on the rails.

In the wafer polishing machine as described above, the polishing pad 106 is secured to the upper surface of the lower polishing plate 102 through the foaming resin sheet 104 which is of 0.5 to 3 mm thick and has a great number of through pores. When pressed by the wafer W, this sheet 104 is elastically deformed so that not only the portion opposing to the wafer W is recessed, but also the portion of a prescribed width extending outwardly from a position corresponding to the outer periphery of the wafer is recessed so as to define a smooth convex surface.

Accordingly, as compared with the case where the polishing pad 106 is directly bonded to the upper surface of the lower polishing plate 102, the wafer W sinks in a greater amount so that the protrusions of the wafer IV are processed more strongly by the polishing pad, and the chemical mechanical reaction is facilitated to improve the flatness. Accordingly, when half-polishing, for example, a polysilicon layer formed by the CVD method, the abnormal protrusions which are susceptible to chemical mechanical polishing are pressed move strongly into the polishing pad and polished away.

Furthermore, the lower surface of the chuck 84 securely fixed to the lower surface of the top ring 76 is comprised of a curved surface formed so that its central portion protrudes downwards. Therefore, by equalizing the abutting pressure of the polishing pad 106 against the periphery of the wafer with the abutting pressure of the polish pad 106 at a central portion of the wafer, the polishing of the wafer can be carried out uniformly over the entire surface thereof.

Since the wafer is caused to sink in the polishing pad during the polishing, a large friction is exerted. Therefore, the top ring 76 is forcibly rotate by rotating the upper polishing shaft 66 by the motor 70 through the belt 72.

After the completion of the polish of the wafer W for a prescribed time, the wafer W is again held by vacuum on the top ring 76, which is then moved upwards. Then, the upper polishing plate assembly 6 is caused to travel over the preliminary cleaning mechanism 9, and vacuum chucking is stopped to release the wafer W into the wafer recess 160 of the wafer-holding member.

After the release of the wafer, the cleaning of the backing pad 84B is effected by passing air and pure water through the vacuum passageway 78 and the porous ceramic chuck 84. If there remain some foreign matters on the surface of the backing pad, there may occur scratches, leading to dimple defects. After the cleaning of the backing pad 84B, the upper polishing plate assembly 6 is returned to a prescribed standby position in the wafer pick-up mechanism 2.

Since cleaning water is overflowed from the cleaning water outlet 9A of the preliminary cleaning mechanism 9, the wafer holding member 156, the engaging claws 154 and the wafer W are placed on the cleaning water outlet 9A with the wafer W being held in contact with the cleaning water outlet 9A. Thus, the wafer W is cleaned over its entire surface while being shaken.

After the completion of the preliminary cleaning of wafer W, the wafer-holding member 156 is moved above the wafer W so as to direct downwards, and driven to hold the wafer W by sandwiching the same with the engaging claws 164. Then, the wafer-holding member 156 is moved above the spinning mechanism 12, and its engaging claws 164 are opened to release the wafer W on the rotary table 188 of the spinning mechanism 12. In this situation, the wafer surface to be polished is facing upwards.

The pressure in the vacuum passageway of the rotary table 188 is then reduced to hold the wafer W by vacuum on the rotary table 188. Subsequently, the detergent brush 184A of the brushing mechanism 14 shown in FIG. 10 is moved above the wafer W and brought into contact with the wafer surface to be polished while blasting detergent against the wafer W through a nozzle (not shown). When the cleaning with detergent is completed, the detergent brush 184A is drawn up, and the pure water brush 184B is brought into contact with the wafer W. Then, while rotating the brush 184B, pure water is blasted on the wafer W through a nozzle.

After the completion of the cleaning with pure water, the both brushes 184A and 184B are retracted, and the rotary table 188 is rotated at high speed to remove water. When the rotation of the table is stopped, the vacuum-holding of wafer W on the rotary table 188 is terminated, and by moving the push-up pins 194 upwards, the wafer W is pushed up and removed from the rotary table 188.

Thereafter, the discharging robot 16 shown in FIG. 12 is activated, and its arm 220 is moved beneath the back surface of the wafer W which is lifted by the push-up pins 194, to thereby cause the back surface of the wafer W to be held on the forward end of the arm 220. Thus, the wafers W are successively inserted into the wafer cassette 1 of the wafer-housing mechanism 18, and the wafer cassette 1 is lifted one step.

By repeating the above operations, time wafers W in the cassette can be automatically and efficiently polished, and high flatness can be achieved. As far as the polishing conditions are set, only the exchange off the cassette containing the wafers to be polished and the discharge of the cassette containing the polished wafers have to be carried out manually. If a device for loading and unloading cassettes may be utilized, a prolonged automatic operation becomes possible.

As described above, in the above polishing apparatus, the wafer accommodated in the cassette is picked up by the wafer pick-up mechanism, positioned in center, held by vacuum on the upper polishing plate assembly, and moved to the polishing mechanism where the wafer is polished. Thereafter, the wafer is released by the preliminary cleaning mechanism, and after being reversed, it is cleaned by brushing, dried by spinning, and accommodated, in the cassette. Further, the dressing of the polishing pad, as well as the automatic cleaning of the polished wafer, the backing pad and jigs contacting the same, can all be carried out automatically.

Furthermore, in the lower polishing plate assembly, the polishing pad is disposed on the upper surface of the lower polishing plate through the foaming resin sheet interposed therebetween, the resin sheet having a great number of through pores and being 0.5 to 3 mm thick. Therefore, the resin sheet is pressed by the wafer and deformed elastically in such a manner that that portion opposing to the wafer sinks while a portion of a prescribed width extending outwardly from the outer periphery around the opposing portion is recessed smoothly. Accordingly, the amount of sinking can be made larger compared with the case where the polishing pad is directly secured to the upper surface of the lower polishing plate, so that even protrusions and mounds of the wafer such as smooth ripples can be pressed strongly, so that the chemical mechanical polishing as described previously can be facilitated. Therefore, the protrusions and mounds are polished off, and the peaks of the upper portions of the ripples are cut, thereby improving the flatness of the wafer.

Moreover, the cleaning of the backing pad secured to the lower surface of the upper polishing plate assembly is carried out by blasting the aerated cleaning water into the vacuum passageway through the porous ceramic chuck. In the case where the lower surface of the porous ceramic chuck is formed by a curved plane having a central portion which is convex in a downward direction, the abutting pressure of the polishing pad can be made equal between the periphery of the wafer and the center of the wafer, so that the undue polishing of the peripheral portion can be avoided.

Obviously, many modifications and variations of the present invention are possible in the light of the above teachings. It is therefore to be understood that within the scope of the appended claims, the invention may be practiced otherwise than as specifically described.

Finally, the present application claims the priority of Japanese Patent Application No. 4-250125 filed on Sep. 18, 1992, which is herein incorporated by reference.

What is claimed is:

1. Apparatus for polishing a wafer comprising:

a. a lower polishing plate assembly having an axis of rotation and dimensioned to have an outer diameter at least twice that of a wafer being polished, said lower polishing plate assembly including a lower polishing plate defining a polishing position for a single wafer on an upper surface thereof and having a spirally extending cooling water passageway formed therein, a polishing pad secured to said upper surface of said lower polishing plate, a porous sheet of a thickness of 0.5 to 3 millimeters formed of a forming resin and interposed between said lower polishing plate and said polishing pad, and a circulating means coupled to said lower polishing plate for supplying cooling water to said cooling-water passageway;

b. a first rotating mechanism attached to said lower polishing plate assembly for rotating said lower polishing plate assembly about said axis of rotation;

c. an upper polishing plate assembly for holding said single wafer, including, an upper polishing plate having an axis of rotation and disposed generally parallel to said lower polishing plate so as to be opposed to said polishing position on said lower polishing plate, said upper polishing plate having a vacuum passageway formed therein to open to a lower surface thereof, a plate-like chuck secured to said lower surface of said upper polishing plate, and a backing pad secured to said chuck, each of said chuck and said backing pad having a plurality of apertures communicating with said vacuum passageway, a pressure reducing means attached to said lower polishing plate for reducing pressure in said vacuum passageway, and a cleaning means attached to said upper polishing plate for blasting cleaning water containing gas into said vacuum passageway to clean said chuck and said backing pad;

d. a second rotating mechanism attached to said upper polishing plate assembly for rotating said upper polishing plate assembly about said axis of rotation, said second rotating mechanism including a supporting mechanism for permitting rotation of said upper polishing plate for tilting movements;

e. a pressing mechanism for pressing said upper polishing plate assembly against said lower polishing plate assembly;

f. a conveying mechanism for bringing a wafer into said polishing position;

g. wherein said porous sheet is constructed such that when the wafer is held between said lower polishing plate and said upper polishing plate, a portion of the porous sheet opposing the wafer sinks while a portion of the porous sheet of a predetermined width extending outwardly from the outer periphery around the opposing portion is recessed smoothly to facilitate half-polishing of the wafer;

h. a wafer pick-up mechanism arranged adjacent to said lower polishing plate assembly for picking up a single wafer from a wafer cassette receiving a plurality of wafers and moving the wafer into a chucking position including, a cassette pedestal for receiving the wafer cassette, said wafer cassette having a side opening for inserting the wafer thereinto and removing the wafer therefrom, said cassette pedestal having a cut-out formed at a position corresponding to said side opening, a conveyer belt means extending to run under said cut-out of said cassette pedestal, a moving means for moving said cassette pedestal to permit the single wafer from the wafer cassette to be placed on the conveyer belt means being activated, a push-up member disposed adjacent to said conveyer belt for pushing up the wafer being conveyed by said conveyer belt means, and a holding claw means for releasably holding the wafer pushed up by said push-up member to effect centering of the wafer;

i. a preliminary cleaning mechanism for preliminarily cleaning the polished wafer with cleaning water;

j. a spinning mechanism having a brushing mechanism to brush the preliminarily cleaned wafer and rotate the preliminarily cleaned wafer to dry the wafer by removing water;

k. a discharging device for discharging the dried wafer; and wherein said conveying mechanism moves said upper polishing plate assembly to a position wherein said chuck can chuck the wafer at said chucking position and to a position above said preliminary cleaning mechanism.

2. Apparatus for polishing a wafer comprising:

a. a lower polishing plate assembly having an axis of rotation and dimensioned to have an outer diameter at least twice that of a wafer being polished, said lower polishing plate assembly including a lower polishing plate defining a polishing position for a single wafer on an upper surface thereof and having a spirally extending cooling water passageway formed therein, a polishing pad secured to said upper surface of said lower polishing plate, a porous sheet of a thickness of 0.5 to 3 millimeters formed of a forming resin and interposed between said lower polishing plate and said polishing pad, and a circulating means coupled to said lower polishing plate for supplying cooling water to said cooling-water passageway;

b. a first rotating mechanism attached to said lower polishing plate assembly for rotating said lower polishing plate assembly about said axis of rotation;

c. an upper polishing plate assembly for holding said single wafer, including, an upper polishing plate having an axis of rotation and disposed generally parallel to said lower polishing plate so as to be opposed to said polishing position on said lower polishing plate, said upper polishing plate having a vacuum passageway formed therein to open to a lower surface thereof, a plate-like chuck secured to said lower surface of said upper polishing plate, and a backing pad secured to said chuck, each of said chuck and said backing pad having a plurality of apertures communicating with said vacuum passageway, a pressure reducing means attached to said lower polishing plate for reducing pressure in said vacuum passageway, and a cleaning means attached to said upper polishing plate for blasting cleaning water containing gas into said vacuum passageway to clean said chuck and said backing pad;

d. a second rotating mechanism attached to said upper polishing plate assembly for rotating said upper polishing plate assembly about said axis of rotation, said second rotating mechanism including a supporting mechanism for permitting rotation of said upper polishing plate for tilting movements;

e. a pressing mechanism for pressing said upper polishing plate assembly against said lower polishing plate assembly;

f. a conveying mechanism for bringing a wafer into said polishing position;

g. wherein said porous sheet is constructed such that when the wafer is held between said lower polishing plate and said upper polishing plate, a portion of the porous sheet opposing the wafer sinks while a portion of the porous sheet of a predetermined width extending outwardly from the outer periphery around the opposing portion is recessed smoothly to facilitate half-polishing of the wafer;

h. a preliminary cleaning mechanism for preliminarily cleaning the polished wafer with cleaning water including, a pan, a mobile support (136) disposed above said pan so as to be movable horizontally, a support member attached to said mobile support so as to be movable up and down, a reversing shaft rotationally secured to said support member and having a wafer-holding member mounted at a distal end thereof, and a water nozzle arranged adjacent to said wafer-holding member for directing cleaning water against the wafer held by the wafer-holding member.

3. Apparatus for polishing a wafer comprising:

a. a lower polishing plate assembly having an axis of rotation and dimensioned to have an outer diameter at least twice that of a wafer being polished, said lower polishing plate assembly including a lower polishing plate defining a polishing position for a single wafer on an upper surface thereof and having a spirally extending cooling water passageway formed therein, a polishing pad secured to said upper surface of said lower polishing plate, a porous sheet of a thickness of 0.5 to 3 millimeters formed of a forming resin and interposed between said lower polishing plate and said polishing pad, and a circulating means coupled to said lower polishing plate for supplying cooling water to said cooling-water passageway;

b. a first rotating mechanism attached to said lower polishing plate assembly for rotating said lower polishing plate assembly about said axis of rotation;

c. an upper polishing plate assembly for holding said single wafer, including, an upper polishing plate having an axis of rotation and disposed generally parallel to said lower polishing plate so as to be opposed to said polishing position on said lower polishing plate, said upper polishing plate having a vacuum passageway formed therein to open to a lower surface thereof, a plate-like chuck secured to said lower surface of said upper polishing plate, and a backing pad secured to said chuck, each of said chuck and said backing pad having a plurality of apertures communicating with said vacuum passageway, a pressure reducing means attached to said lower polishing plate for reducing pressure in said vacuum passageway, and a cleaning means attached to said upper polishing plate for blasting cleaning water containing gas into said vacuum passageway to clean said chuck and said backing pad;

d. a second rotating mechanism attached to said upper polishing plate assembly for rotating said upper polishing plate assembly about said axis of rotation, said second rotating mechanism including a supporting mechanism for permitting rotation of said upper polishing plate for tilting movements;

e. a pressing mechanism for pressing said upper polishing plate assembly against said lower polishing plate assembly;

f. a conveying mechanism for bringing a wafer into said polishing position;

g. wherein said porous sheet is constructed such that when the wafer is held between said lower polishing plate and said upper polishing plate, a portion of the porous sheet opposing the wafer sinks while a portion of the porous sheet of a predetermined width extending outwardly from the outer periphery around the opposing portion is recessed smoothly to facilitate half-polishing of the water;

h. a wafer pick-up mechanism arranged adjacent to said lower polishing plate assembly for picking up a single wafer from a wafer cassette receiving a plurality of wafers and moving the wafer into a chucking position;

i. a preliminary cleaning mechanism for preliminarily cleaning the polished wafer with cleaning water;

j. a spinning mechanism having a brushing mechanism to brush the preliminarily cleaned wafer and rotate the preliminarily cleaned wafer to dry the wafer by removing water, and including a rotary table for receiving the wafer thereon, means attached to said rotary table for holding the wafer by vacuum on said rotary table, drive means attached to said rotary table for rotating the rotary table, and a push-up means disposed adjacent to said rotary table for pushing up the wafer held to the rotary table;

k. a discharging device for discharging the dried wafer; and l. wherein said conveying mechanism moves said upper polishing plate assembly to a position wherein said chuck can chuck the wafer at said chucking position and to a position above said preliminary cleaning mechanism.

4. Apparatus according to claim 3, wherein said brushing mechanism includes:

a. a mobile support arranged to be movable horizontally;

b. a mounting means attached to said mobile support so as to be movable up and down; and c. first and second brushes attached to said mounting means, wherein said first brush is for use with detergent and said second brush is for use with water.

* * * * *